US006564025B2

(12) United States Patent
Sameshima et al.

(10) Patent No.: US 6,564,025 B2
(45) Date of Patent: May 13, 2003

(54) IMAGE FORMING APPARATUS WITH RECORDING MATERIAL CONVEY VELOCITY CONTROL FEATURE

(75) Inventors: Takao Sameshima, Mishima (JP); Shoji Maruyama, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/051,315

(22) Filed: Jan. 22, 2002

(65) Prior Publication Data

US 2002/0061198 A1 May 23, 2002

Related U.S. Application Data

(63) Continuation of application No. 09/580,586, filed on May 30, 2000, now abandoned.

(30) Foreign Application Priority Data

May 31, 1999 (JP) ..... 11-151510
May 31, 1999 (JP) ..... 11-151511

(51) Int. Cl.[7] ..... G03G 15/20
(52) U.S. Cl. ..... 399/68; 399/397; 399/400
(58) Field of Search ..... 399/66, 67, 68, 399/394, 396, 397, 400, 167, 327; 347/153, 154

(56) References Cited

U.S. PATENT DOCUMENTS 5,740,503 A * 4/1998 Nakamura ..... 399/167
5,771,434 A * 6/1998 Hokari ..... 399/400
5,970,298 A * 10/1999 Seki et al. ..... 399/327

FOREIGN PATENT DOCUMENTS

| | | |
|---|---|---|
| JP | 5-107966 | 4/1993 |
| JP | 7-181830 | 7/1995 |
| JP | 10-097154 | 4/1998 |

* cited by examiner

*Primary Examiner*—Hoan Tran
(74) *Attorney, Agent, or Firm*—Fitzpatrick, Cella, Harper & Scinto

(57) ABSTRACT

An image forming apparatus includes an image bearing body. A transferring portion transfers an unfixed image in the image bearing body onto a recording material, while conveying the recording material. A fixing portion fixes the unfixed image onto the recording material, while conveying the recording material having the unfixed image is transferred in the transferring portion. A flexure detecting device detects flexure of the recording material between the transferring portion and the fixing portion. A recording material detecting device detects the presence/absence of the recording material at a downstream side of the fixing portion with respect to a conveying direction of the recording material. A control device controls a convey velocity of the recording material in the fixing portion on the basis of a time from the detection of the recording material detected by the recording material detecting device to the detection of the flexure of the recording material detected by the flexure detecting device.

21 Claims, 9 Drawing Sheets

IMAGE FORMING APPARATUS WITH RECORDING MATERIAL CONVEY VELOCITY CONTROL FEATURE

This is a continuation application of application Ser. No. 09/580,586, filed May 30, 2000, now abandoned.

BACKGROUND OF THE INVENTION

1. Field of the Invention

The present invention relates to an image forming apparatus such as a copying machine, a printer, a facsimile, etc. using an electrophotographic system, and particularly relates to convey velocity control of a recording material.

2. Related Background Art

In a conventional image forming apparatus, a recording material such as recording paper, etc. is conveyed onto a recording material conveying path by using a roller, etc. There is a case in which conveying force is simultaneously given to one recording material by different conveying means on upstream and downstream sides of the conveyed recording material in its conveying direction.

In one example of such a conveying form, the image forming apparatus is constructed by a transferring portion for transferring a toner image on a photosensitive drum as an image bearing body to the recording material, and the recording material passing through this transferring portion is conveyed to a fixing nip portion of a fixing portion. A difference in convey velocity is set between the above transferring portion and the above fixing nip portion so as to provide flexure (loop) to the recording material to a certain extent between the above transferring portion and the above fixing nip portion.

There is a system for fixedly setting a preset velocity difference without performing the velocity control as a system for setting such a difference in convey velocity.

The recording material convey velocity of the fixing portion and the recording material convey velocity of the transferring portion are different from each other by thermal expansion of a fixing roller of the fixing portion and an individual difference or a change with the passage of time so that the recording material is tensioned between the above fixing portion and the above transferring portion and an image is deteriorated by this tension. For example, in an image forming apparatus proposed in Japanese Patent Application Laid-Open No. 10-97154, a loop detecting sensor for detecting the loop of the recording material is arranged between the above fixing portion and the above transferring portion as one means for solving the problem of this image deterioration. A control clock period of a stepping motor as a drive motor of the fixing roller is shortened in accordance with detecting results of this loop detecting sensor. Then, a velocity of the drive motor is increased for a constant time and the loop of the recording material is reduced. Thereafter, when a loop amount is reduced, the velocity of the drive motor is returned to its original velocity.

Further, in an image forming apparatus proposed in Japanese Patent Application Laid-Open No. 07-181830, a loop detecting sensor for detecting the loop of the recording material is arranged between the above fixing portion and the above transferring portion. The velocity of a motor for operating a pressurizing roller of the fixing portion is stepwise switched from detecting results of the loop detecting sensor so that the loop amount of the recording material is constantly set.

However, in the above conventional examples, when the recording material is first conveyed with a constant velocity difference without performing the velocity control, a conveying means of a roller, etc. is thermally expanded by e.g., heat of a fixing apparatus and is changed in diameter. Thus, the convey velocity is changed and the velocity difference between front and rear units is increased or reversed. Accordingly, it is considered that this increase in velocity difference, etc. have influence on image quality and conveying performance such as an increase in loop and tension due to a downstream unit.

When the loop of the recording material is detected by the loop detecting sensor such as a photointerrupter, etc., presence/absence of a predetermined amount of loop can be detected. However, for example, it is impossible to perform delicate control in which the tension in the downstream unit is removed while a certain amount of loop is secured at any time, and the recording material is conveyed while rubbing of an image caused by the increase in loop is conversely prevented.

Further, in a color image forming apparatus for transferring plural colors to recording paper, control of the convey velocity is an important problem to provide a color image forming apparatus of high image quality since a change in load during a transferring operation has great influence on a shift in each color, etc.

In particular, in a color LBP of a tandem type for directly transferring four colors of yellow (Y), magenta (M), cyan (C) and black (Bk) to the recording material at any time, the distance between the transfer and the fixation (fixing) is short and there is a state in which the recording material is nipped between plural transferring portions and the fixing means. Therefore, it is important to control the convey velocity between the transfer and the fixation.

Further, when the fixing means is a fixing device of an on-demand system such as an electromagnetic induction system and a film fixing system, the convey velocity of the recording material is greatly dispersed by a kind of the recording material and a continuous sheet passing number in comparison with the conventional fixing device of a heat-pressurizing rubber roller pair having a halogen lamp, etc. within this fixing device so that the loop amount between the transfer and the fixation is greatly changed. Therefore, in the fixing devices of these systems, it is particularly desired to perform delicate control in which the tension in the fixing means is removed while a certain amount of loop is secured at any time, and the recording material is conveyed while rubbing of an image caused by the increase in loop and the shift in each color due to the change in load with respect to the recording material are conversely prevented.

SUMMARY OF THE INVENTION

An object of the present invention is to provide an image forming apparatus for preventing an image shift and image rubbing by controlling the flexing amount of a recording material.

Another object of the present invention is to provide an image forming apparatus comprising an image bearing body; a transferring portion for transferring an unfixed image on the image bearing body onto a recording material while conveying the recording material; a fixing portion for fixing the unfixed image onto the recording material while conveying the recording material having the unfixed image transferred in the transferring portion is conveyed; flexure detecting means for detecting flexure of the recording material between the transferring portion and the fixing portion; recording material detecting means for detecting presence/absence of the recording material on a downstream side of the fixing portion with respect to a conveying direction of the recording material; and control means for controlling a convey velocity of the recording material in the fixing portion on the basis of a time from the detection of the recording material detected by the recording material detecting means to the detection of the flexure of the recording material detected by the flexure detecting means.

A still another object of the present invention is to provide an image forming apparatus comprising first conveying means and second conveying means for conveying a recording material; flexure detecting means for detecting flexure of the recording material between the first and second conveying means; recording material detecting means for detecting presence/absence of the recording material on a downstream side of the second conveying means with respect to the conveying direction of the recording material, the first conveying means being arranged on an upstream side of the second conveying means with respect to a conveying direction of the recording material; and control means for controlling a recording material convey velocity of at least one of the first and second conveying means on the basis of a time from the detection of the recording material detected by the recording material detecting means to the detection of the flexure of the recording material detected by the flexure detecting means.

A still another object of the present invention is to provide an image forming apparatus comprising an image bearing body; a transferring portion for transferring an unfixed image on the image bearing body onto a recording material while conveying the recording material; a fixing portion for fixing the unfixed image onto the recording material while conveying the recording material having the unfixed image transferred in the transferring portion; and a guide member arranged over a width of the recording material in a direction perpendicular to a moving direction of the recording material and guiding the recording material to the fixing portion; the guide member being movable and flexure of the recording material between the transferring portion and the fixing portion being detected by movement of the guide member.

Further objects of the present invention will become apparent from the following description.

DESCRIPTION OF THE PREFERRED EMBODIMENTS

The embodiments of the present invention will next be described on the basis of the drawings.

Figure 1:
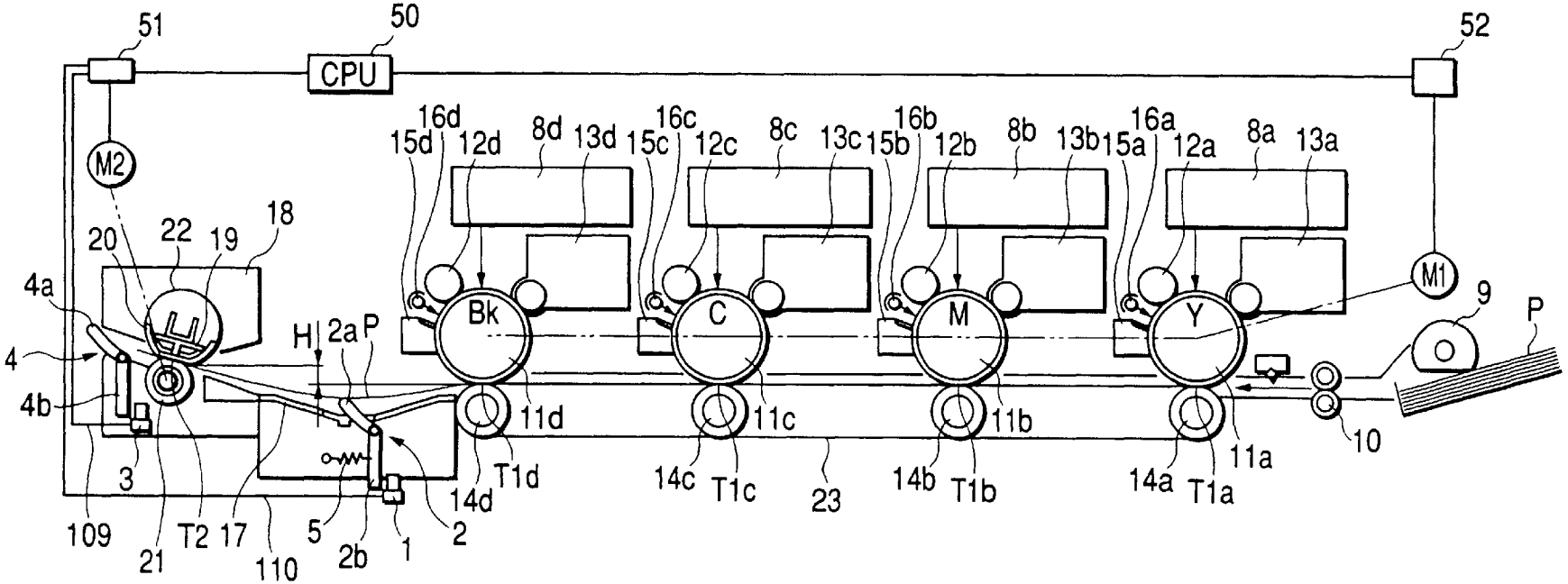
FIG. 1 is a view showing an image forming apparatus in an embodiment of the present invention.

FIG. 1 shows a main section of a color LBP (color laser printer) of a tandem type in which the present invention is embodied.

Each of reference numerals 11*a* to 11*d* designates an electrophotographic photosensitive body (hereinafter described as a photosensitive drum) of a drum type as a latent image bearing body rotated at a predetermined process speed in the clockwise direction in FIG. 1. The photosensitive drums 11*a*, 11*b*, 11*c* and 11*d* sequentially take partial charge of yellow (Y), magenta (M), cyan (C) and black (Bk) components of a color image, respectively. A drum motor (direct current servo motor) M1 rotates these photosensitive drums 11*a*, 11*b*, 11*c* and 11*d*. One drum motor M1 operates the four photosensitive drums, but an independent driving source may be also arranged with respect to each of these photosensitive drums. A digital signal processor (DSP) 52 controls the rotation of the drum motor M1 and the other controls are performed by a CPU 50.

Yellow among the four colors will next be explained as an example. The photosensitive drum 11*a* is uniformly primarily charged and processed by a primary charging roller 12*a* as a primary charging means in a rotating process of this drum such that this photosensitive drum 11*a* has predetermined polarity and electric potential. An optical image is then exposed by a laser beam exposing means (hereinafter described as a scanner) 8*a* and an electrostatic latent image of image information is formed.

Next, a toner image is formed on the photosensitive drum 11*a* and is visualized by a developing device 13*a*. Similar processes are also performed with respect to the other three colors. Reference numerals 12*b*, 12*c*, 12*d* designate primary charging rollers, and reference numerals 8*b*, 8*c*, 8*d* designate scanners, and reference numerals 13*b*, 13*c*, 13*d* designate developing devices.

These toner images are synchronized with each other by a registration roller pair 10 for stopping and reconveying a recording material P conveyed by a sheet feeding roller 9 in predetermined timing. The respective colors of these toner images are sequentially transferred to the recording material P in transferring nip portions T1*a*, T1*b*, T1*c*, T1*d* formed by transferring rollers 14*a*, 14*b*, 14*c*, 14*d* and the photosensitive drums 11*a*, 11*b*, 11*c*, 11*d* through an electrostatic adsorption conveying belt 23.

Simultaneously, remaining attachments such as transferring remaining toner, etc. are processed by cleaning means 15*a*, 15*b*, 15*c*, 15*d* in the photosensitive drums 11*a*, 11*b*, 11*c*, 11*d* after the toner images are transferred to the recording material P. Electricity removing processing is then performed by eraser lamps 16*a*, 16*b*, 16*c*, 16*d* in the photosensitive drums 11*a*, 11*b*, 11*c*, 11*d* and an image is repeatedly made.

The recording material P having the toner image transferred in the transferring portion T1*d* is separated from a face of the photosensitive drum 11*d* and is conveyed onto a conveying guide 17 and is sent to a fixing device 18.

In contrast to this, a pressurizing roller 21 arranged within the fixing device 18 is rotated in the counterclockwise direction in FIG. 1 by a fixing motor M2 (a direct current servo motor) controlled in rotation by a DSP (digital signal processor) 51. A magnetizing coil 20 as a heating means is connected to an unillustrated excitation circuit of a main body of the image forming apparatus. Magnetic force is generated by applying a higher frequency bias to the magnetizing coil 20 by this excitation circuit. The pressurizing roller 21 has an elastic layer of rubber, etc. and drives a film 22.

An induced current (eddy current) is generated by an action of this magnetic force in a heating layer (ferromagnetic conductive layer) of the film 22 of an endless shape as a rotating body so that an electromagnetic induction heating state is attained. The recording material P having the unfixed toner thereon is conveyed and introduced from this state to a fixing nip portion T2 between the film 22 and the pressurizing roller 21. Thus, the pressurizing force of an unillustrated pressurizing spring and the heat from the film 22 heated by the electromagnetic induction are applied to the unfixed toner so that the unfixed toner is softened and melted and comes in press contact with the recording material P. Thereafter, the toner is cooled and set to a permanent fixed image. At this time, as shown in FIG. 1, the recording material P moved on the conveying guide 17 is conveyed while the recording material P comes in contact with one lever portion (loop sensor flag) 2*a* projected in a recording material conveying face of a swinging lever 2. A flexure detecting means for detecting flexure (loop) of the recording material is constructed by the swinging lever 2, a sensor 1, etc.

At this time, the loop sensor flag 2*a* is biased by a tension spring 5 at a predetermined spring pressure in the clockwise direction in the state of FIG. 1.

Thereafter, the recording material P discharged from the nip portion T2 between the film 22 and the pressurizing roller 21 hits against one lever portion (sheet discharging sensor flag) 4*a* projected onto a recording material conveying face of a swinging lever 4, and the other lever portion 4*b* interrupts the optical path of a sheet discharging sensor 3 constructed by a photointerrupter. Thus, a state from OFF (paper absence (nonexistence)) to ON (paper presence (existence)) is detected. A recording material detecting means for detecting the presence/absence of the recording material is constructed by the swinging lever 4, the sensor 3, etc. The photosensitive drum and the belt constitute a first conveying means of the recording material, and the fixing device arranged on a downstream side of this first conveying means in a moving direction of the recording material constitutes a second conveying means of the recording material.

Here, a recording material convey velocity v1 (mm/s) in the fixing device 18 is set such that this recording material convey velocity is lower than a recording material convey velocity v0 (mm/s) in the transferring portion.

Namely, when a kind of the recording material in the fixing device 18, a continuous sheet passing number, thermal expansion of each of the parts in a temperature adjusting situation, dispersion in the pressurizing force, tolerance of a roller diameter, etc. are considered, a highest recording material convey velocity in the fixing device is set to v1 and v0>v1 is set. Accordingly, a loop amount is increased by a difference in convey velocity between the transferring portion and the fixing portion of the recording material P from state of FIG. 1 when a tip portion of the recording material P is nipped by the nip portion T2 of the fixing device 18. Note that a length of the recording material of at least a maximum size is set to be longer than the distance between the transferring portion and the fixing portion.

Figure 2:
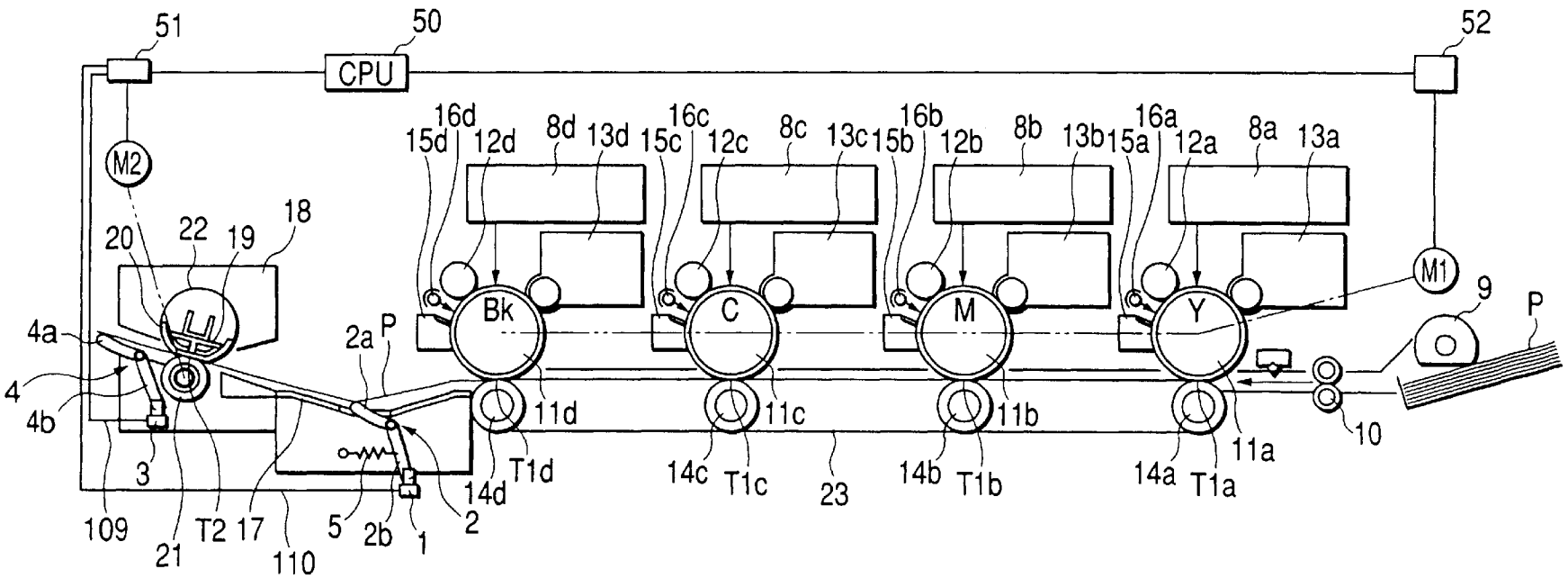
FIG. 2 is a view showing a state in which a predetermined flexing amount of a recording material is caused.

In the state of FIG. 2, the tension spring 5 biasing the loop sensor flag 2*a* is tensioned by the strength of firmness provided by the loop of the recording material P and the other lever portion 2*b* of the swinging lever 2 interrupts the optical path of the loop sensor 1 constructed by a photointerrupter so that an OFF state is changed to an ON (loop detection) state. The loop sensor 1 detects a predetermined amount of flexure (loop) of the recording material.

Here, the fixing nip portion T2 is arranged in a position higher by a height H than the transferring nip portion T1*d* such that the loop is downward generated by the recording material convey velocity difference between the fixation and the transfer as shown in FIG. 1.

When the loop amount on the conveying guide 17 of the recording material P in FIG. 2 is set to an appropriate state, it is preferable to adjust the recording material convey velocity in the fixing portion so as to hold this state.

However, the recording material convey velocity v0 in the transferring nip portion T1 is approximately constant, but the recording material convey velocity v1 in the fixing nip portion T2 is greatly changed by a kind of the recording material, a continuous sheet passing number, thermal expansion of each of the parts in a temperature adjusting situation, dispersion in the pressurizing force, tolerance of a roller diameter, etc. as mentioned above.

Therefore, as the convey velocity difference of the recording material P between the fixing nip portion T2 and the transferring nip portion T1 is increased, the recording material convey velocity in the fixing nip portion T2 at present must be correspondingly accelerated after the loop sensor 1 is turned on. As a result, after the loop is reduced and the loop sensor 1 is turned off, the recording material convey velocity must be decelerated to an appropriate recording material convey velocity. Here, such a situation is also caused in a case in which the recording material convey velocity on a fixing device side at a decelerating time is higher than the recording material convey velocity initially set.

Namely, it is necessary to accelerate and decelerate the recording material convey velocity in accordance with the convey velocity difference of the recording material P between the fixing nip portion T2 and the transferring nip portion T1.

In a means for detecting this recording material convey velocity difference between the fixing nip portion T2 and the transferring nip portion T1, the sheet discharging sensor 3 arranged in the vicinity of a discharging side of the fixing device 18 is pushed by a tip portion of the recording material P and is turned on. Thereafter, the loop amount generated by the recording material convey velocity difference between the transferring portion and the fixing portion reaches a predetermined amount, and the loop sensor 1 is turned on by rigidity (firmness) of this recording material P. A magnitude of the recording material convey velocity difference between the transferring portion and the fixing portion can be known by a time from the turning-on of the sheet discharging sensor 3 to the turning-on of the loop sensor 1.

Namely, as the time from the turning-on of the sheet discharging sensor 3 to the turning-on of the loop sensor 1 is shortened, the recording material convey velocity difference between the transferring portion and the fixing portion is increased.

As mentioned above, the rotating velocity of the fixing motor M2 must be controlled to constantly hold the loop amount between the transferring portion and the fixing portion by controlling the recording material convey velocity in the fixing nip portion T2 of the fixing device 18.

Figure 3:
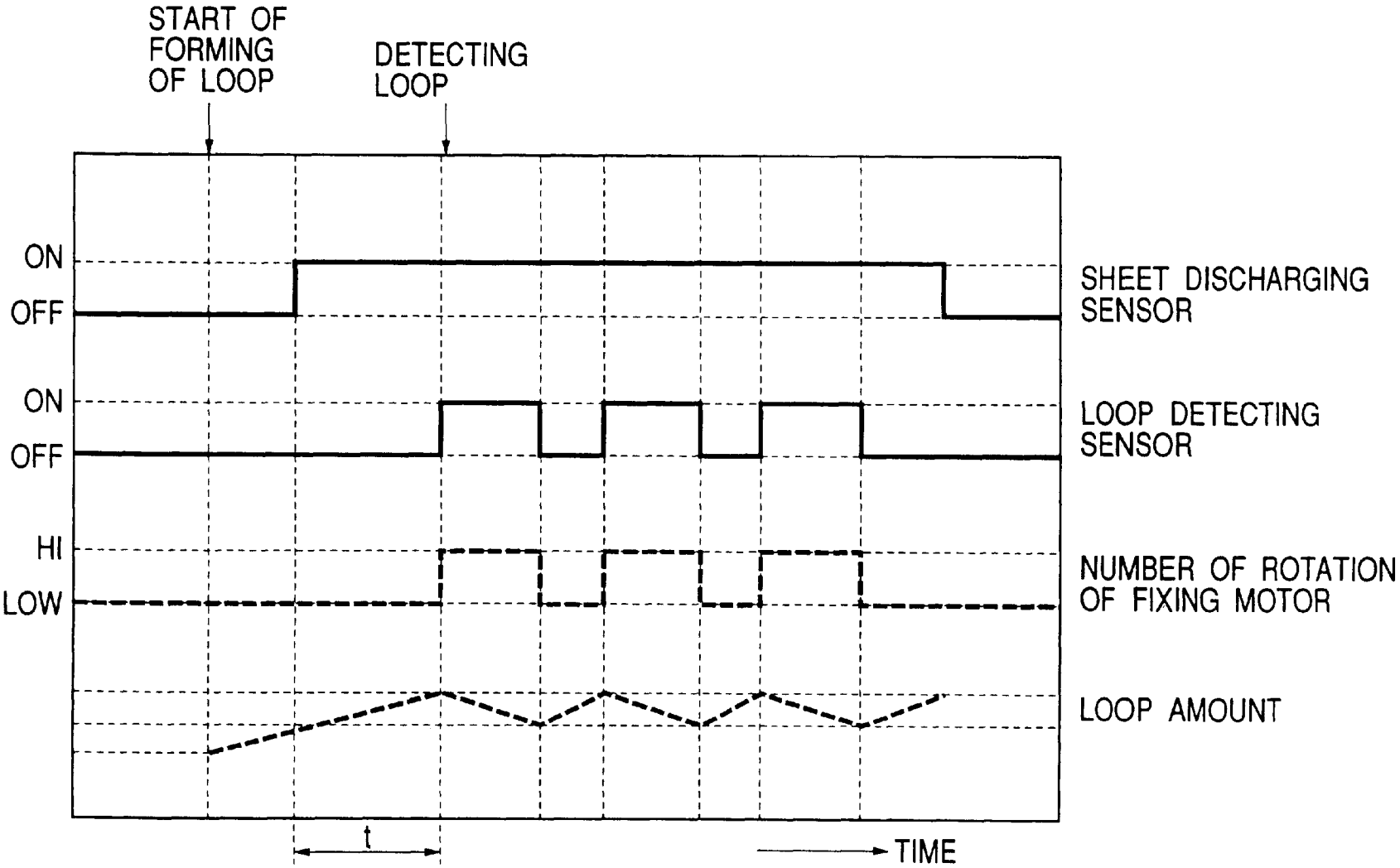
FIG. 3 is a timing chart of a sensor and a motor.

FIG. 3 shows a velocity control image view when the loop sensor is repeatedly turned on and off after the sheet discharging sensor is turned on.

In FIG. 3, the velocity control is performed three times in accordance with the turning-on and turning-off operations of the loop sensor, but loop control terminated by one velocity control may be also set.

Figure 4:
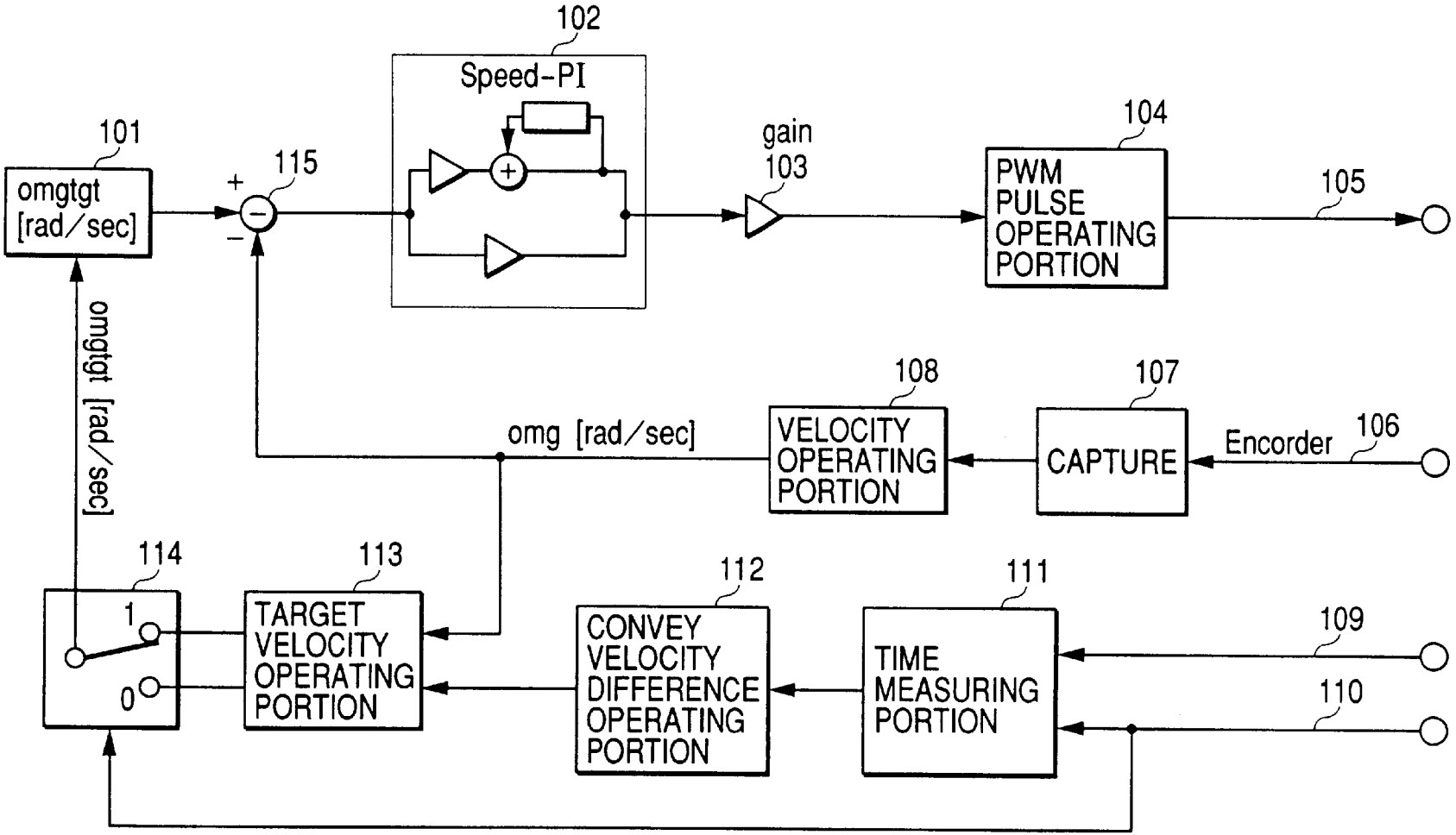
FIG. 4 is a servo control block diagram of the motor.

FIG. 4 shows a servo control block diagram of the fixing motor using the DSP (digital signal processor) 51 in FIG. 1.

In the image forming apparatus in this embodiment, the CPU 50 and the DSP 51 are arranged in a control portion and the operation of a motor is controlled by the DSP 51 and the other controls are performed by the CPU 50. In FIG. 3, the DSP receives driving/stopping commands of the motor from the unillustrated CPU and performs servo control of the motor and transmits status information of the motor to the CPU.

In FIG. 4, reference numerals 101, 102 and 103 respectively designate a control target velocity (rad/sec) of the motor, a PI filter and a gain. Reference numerals 104, 105 and 106 respectively designate a PWM pulse width operating portion, a PWM signal, an output signal of an MR sensor in which the motor generates 360 pulse signals per one rotation. Reference numerals 107, 108, 109 and 110 respectively designate a capture for measuring a pulse interval of the above MR sensor, a velocity operating portion for calculating the velocity (rad/sec) of the motor from measuring results of the capture 107, a signal from the sheet discharging sensor 3, and a signal from the loop sensor 1. A time measuring portion 111 measures a time from edge timing of ON (paper existence) of the sheet discharging sensor 3 to edge timing of ON (loop detection) of the loop sensor 1. A convey velocity difference operating portion 112 calculates the convey velocity difference between the recording material convey velocity of the fixing portion and the recording material convey velocity of the transferring portion. A control target velocity operating portion 113 calculates a control target velocity of the motor in ON and OFF states of the loop sensor 1 from calculating results of the convey velocity difference operating portion 112. A switching control portion 114 selectively switches calculating results of the control target velocity operating portion 113 in accordance with the states of the loop sensor 1.

A servo control operation of the motor using the circuit having the above construction will be explained.

A control target velocity (rotation number) 101 of the motor is provided and this target velocity and the actual motor velocity (omg) calculated in the velocity operating portion 108 are compared with each other in a subtracter 115. The difference between these velocities is calculated by the PI filter 102 and a gain 103 is added and a PWM pulse width is calculated in the PWM pulse operating portion 104 in accordance with this value.

ON-duty is determined with respect to a carrier determined by an unillustrated PWM carrier frequency generating circuit from the PWM pulse width. For example, when the carrier frequency is set to 20 kHz (50 $\mu$s) and the PWM pulse width is defined by 8 bits, the ON-duty is 50% and the pulse width is 25 $\mu$s in the PWM pulse width of '7F'H, and the ON-duty is 25% and the pulse width is 12.5 $\mu$s in the PWM pulse width of '40' H.

Velocity calculating processing for measuring a pulse interval of the signal 106 from the MR sensor by the capture 107 and calculating the actual velocity of the motor by the velocity operating portion 108 is performed every pulse input of the MR sensor. Further, processing for calculating the velocity difference from the subtracter 115 by the PI filter 102 and adding the gain 103 and calculating a PWM signal 105 in the PWM pulse operating portion 104 from the added gain is feedback-controlled at a control frequency of 1 kHz in consideration of responsibility of the motor.

Next, a tip of the recording material reaches the sheet discharging sensor 3. The time measuring portion 111 measures a time from timing of OFF to ON of a sensor output as a signal 109 from the sheet discharging sensor 3 to timing of OFF to ON of the loop sensor 1 attained by forming the loop by the recording material. The convey velocity difference operating portion 112 calculates the difference between the recording material convey velocity of the fixing portion and the recording material convey velocity of the transferring portion from measuring results of the time measuring portion 111. For example, when the convey velocity of the transferring portion is set to v0 (mm/s) and the convey velocity of the fixing portion is set to v1 (mm/s) and the measured time of the time measuring portion 111 is set to t (s) and v0>v1 is set, $(v0-v1)=k\cdot 1/t$ (k is a constant) is satisfied.

Namely, when the convey velocity of the fixing portion is lower than the convey velocity of the transferring portion, the loop is rapidly formed as the convey velocity difference is increased. Therefore, the time t from the arrival of the tip of the recording material at the sheet discharging sensor 3 to the detection of the loop performed by the loop sensor 1 is shortened.

In contrast to this, the constant k is mainly changed by a paper kind and a sensor attaching accuracy. However, if the constant k is set in advance, the convey velocity difference (v0−v1) is easily calculated.

Next, the motor control target velocity is newly set by calculating $+\Delta v1$ and $-\Delta v2$ on the basis of a test formula calculated in advance. $+\Delta v1$ is a value showing an increasing degree of the motor control target velocity (reducing the loop amount) at an ON (loop detection) time of the loop sensor 1 from the convey velocity difference calculated by the convey velocity difference operating portion 112. $-\Delta v2$ is a value showing a decreasing degree of the motor control target velocity (increasing the loop amount) at an OFF (loop undetection) time of the loop sensor 1. $+\Delta v1$ and $-\Delta v2$ are increasing and decreasing values provided when no loop can be formed, i.e., the same velocity in the fixing portion as the velocity in the transferring portion is set to a reference.

Namely, $+\Delta v1$ and $-\Delta v2$ calculated in the convey velocity difference operating portion 112 are added to the actual motor control velocity already calculated by the velocity operating portion 108 in the target velocity operating portion 113. The motor control target velocity at the ON time of the loop sensor 1 and the motor control target velocity at the OFF time of the loop sensor 1 are calculated. In the switching control portion 114, the motor control target velocities calculated above are switched and controlled in accordance with the states (ON or OFF) of the loop sensor 1 and servo control of the motor is performed with this target velocity as a control target velocity 101 of the motor.

Figure 5:
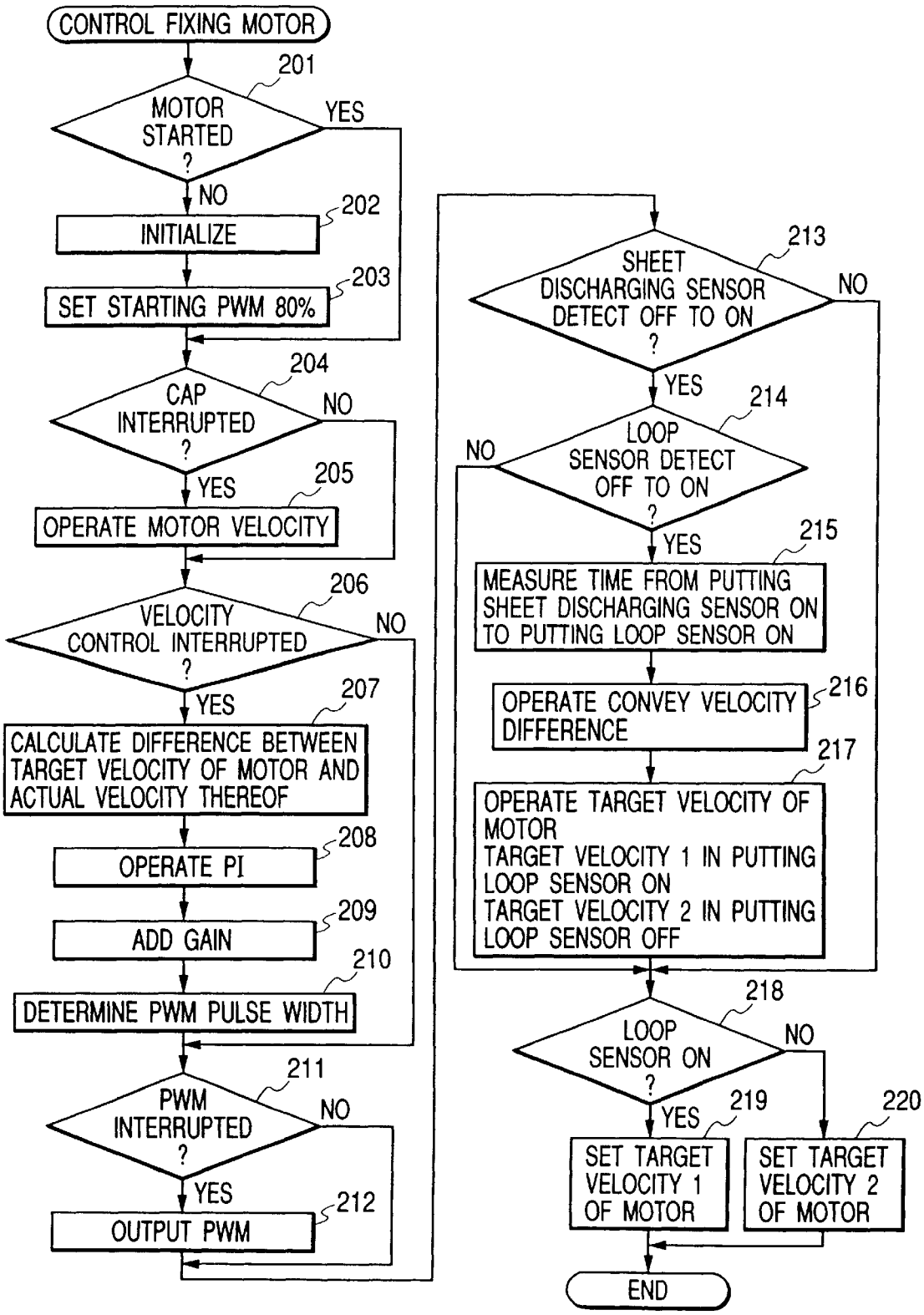
FIG. 5 is control flowchart of the motor.

FIG. 5 is a control flowchart of the fixing motor using the DSP (digital signal processor).

A control flow will be explained by using FIG. 5.

In a step 201, a starting state of the motor is confirmed. When no motor is started, a register, a timer, a port, etc. are initially set in a step 202. In a step 203, ON-duty of PWM at the starting time is fixedly set to 80%. Thus, a PWM width for optimizing rising without overshoot with respect to the target velocity is determined while torque sufficient to accelerate the motor is given in a state in which load torque and load inertia are connected by accelerating torque of the motor at the starting time. In contrast to this, if the motor is already started in the step 201, this step 201 is jumped.

Next, in a step 204, interruption of the capture (CAP) is confirmed. In reality, it proceeds to a capture processing routine by interruption processing, and a motor velocity is calculated in a step 205. Namely, when the motor is rotated, 360 pulses per one rotation are outputted from the MR sensor. Detecting an edge of each of these pulses generates interruption. Namely, interruption is generated every arrival of the pulse edge. An interval of the above pulses is measured by an unillustrated capture circuit arranged in the DSP. If this interval time is set to tcap (s), the motor velocity (rad/s) is calculated by $(2\pi/360)/tcap$. This series of controls corresponds to processings in portions 106 to 108 in FIG. 4.

Next, it is confirmed in a step 206 whether velocity control interruption is generated or not. In reality, when interruption is generated by the velocity control interruption processing, the motor control target velocity and the actual motor velocity are compared with each other in a step 207. In a step 208, a PI filter operation is performed. In a step 209, a gain is added. In a step 210, a PWM pulse width according to these calculating results is determined. These operations in steps 208 to 210 are operations for stably controlling the operation of a servo control system and correspond to processings in portions 102 to 104 in FIG. 4. The motor control target velocity is constructed by a motor target velocity 1 higher than the velocity in the transferring portion and a motor target velocity 2 lower than the velocity in the transferring portion.

Next, it is confirmed in a step 211 whether PWM interruption is generated or not. In reality, hardlike interruption is generated every PWM carrier frequency set in advance. Namely, the image forming apparatus has a circuit for generating interruption of 20 kHz when the carrier frequency is set to 20 kHz. When this interruption is generated, a PWM signal having the PWM pulse width calculated in the step 210 is outputted in a step 212. For example, when the PWM pulse width is set to an 8-bit width and is set to '7F'H in value in the calculating results in the step 210 and the carrier frequency is set to 20 kHz, a PWM signal having 25 μs in the PWM pulse width and 50% in ON-duty is outputted.

In contrast to this, when no interruption is generated in the step 211, no PWM signal is outputted.

Next, in a step 213, the sheet discharging sensor 3 detects a change from OFF (paper nonexistence) to ON (paper existence). Namely, the sheet discharging sensor 3 detects the timing of a tip of the conveyed recording material reaching the sheet discharging sensor 3 (a lever portion 2*a* of the swinging lever 2 for the sheet discharging sensor). When this timing is detected, the loop sensor 1 detects a change from OFF (paper nonexistence) to ON (paper existence) in a step 214. Namely, the conveyed recording material is loop-formed and the loop sensor detects detection timing.

When the loop is detected, a time from the arrival of the tip of the recording material at the sheet discharging sensor 3 to an ON time of the loop sensor 1 is measured in a step 215. In a step 216, the difference between the convey velocity of the transferring portion and the convey velocity of the fixing portion is calculated. In a step 217, the control target velocity at the ON time of the loop sensor 1 and the control target velocity at the OFF time of the loop sensor 1 are newly set.

Operations in these steps 213 to 217 correspond to processings in portions 111 to 113 in FIG. 4.

Next, when the loop sensor 1 is turned on in a step 218, the control target velocity calculated in the step 217 at the ON time of the loop sensor 1 is switched. In contrast to this, when the loop sensor 1 is turned off in the step 218, the control target velocity calculated in the step 217 at the OFF time of the loop sensor 1 is switched. Thus, the velocity control of the fixing motor is performed.

Thus, after the tip of the recording material arrives at the sheet discharging sensor, the loop is formed in the recording material and the loop sensor 1 is turned on when the convey velocity of the fixing portion is low and the convey velocity of the transferring portion is high. The convey velocity difference between the fixing portion and the transferring portion is calculated by measuring a time from this arrival to the turning-on operation of the loop sensor 1. The control target velocity of the fixing motor is set and controlled in accordance with calculating results of this convey velocity difference.

In contrast to this, when the above change is not detected in the step 213, it is jumped to the step 218. When the above change is not detected in the step 214, it is also jumped to the step 218.

In this case, when the loop sensor is turned on in the step 218, the motor target velocity 1 in the step 207 is set. In contrast to this, when the loop sensor is turned off, the motor target velocity 2 in the step 207 is maintained as it is.

When no loop sensor is changed from OFF to ON in the step 214 even after a first predetermined time has passed from a changing time of the sheet discharging sensor from OFF to ON, it proceeds to the step 218. When the loop sensor is turned off, the motor target velocity 2 first set in the step 207 is maintained as it is. However, when the first predetermined time has passed and a second predetermined time has further passed from the changing time of the sheet discharging sensor from OFF to ON, the motor target velocity in a step 220 may be also set to a motor target velocity lower than the motor target velocity 2 in the step 207.

Figure 6:
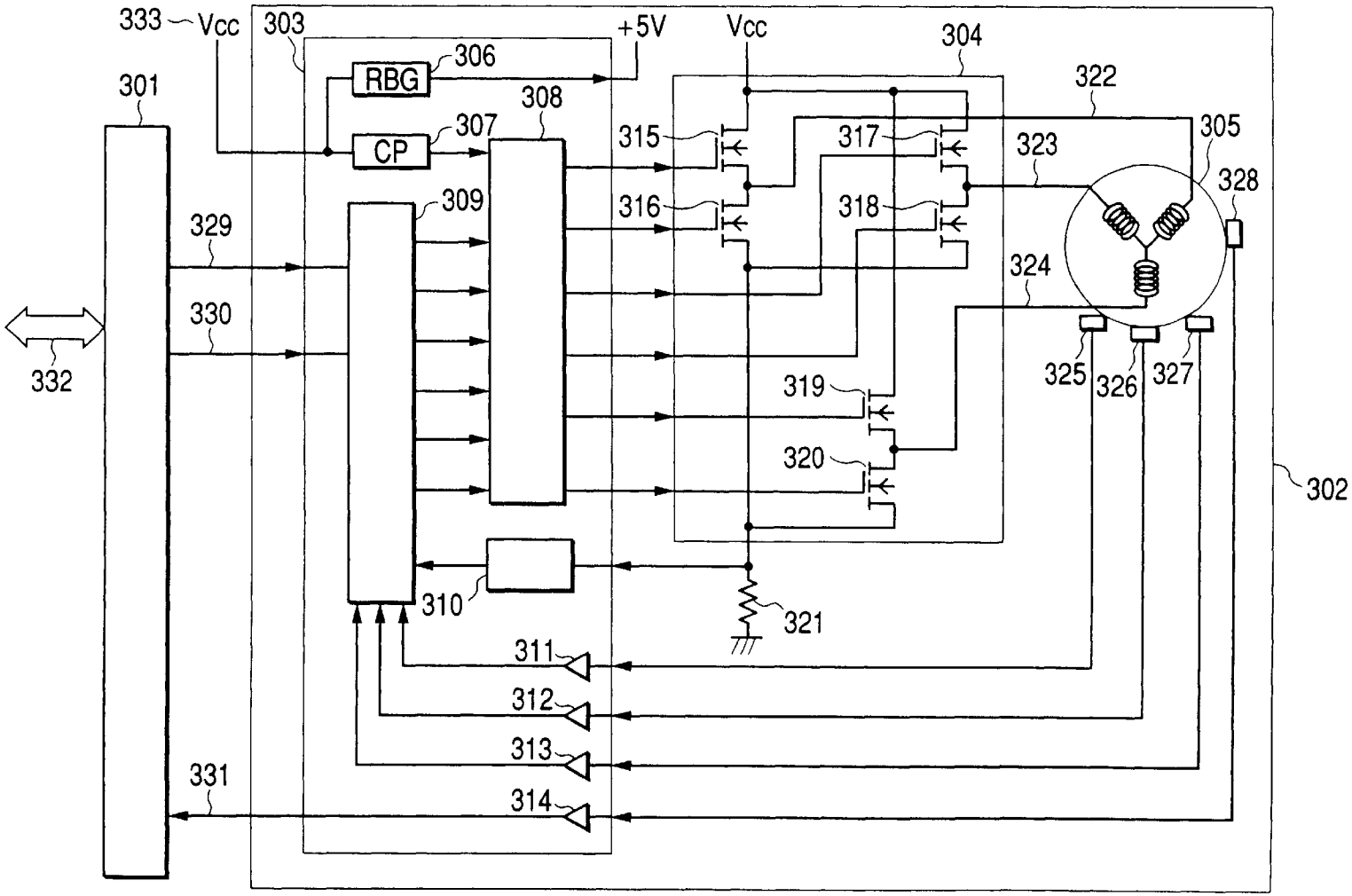
FIG. 6 is a block diagram of the motor and a control circuit.

FIG. 6 is a block diagram of the fixing motor and a control circuit.

In FIG. 6, reference numerals 301, 302 and 303 respectively designate a DSP for communicating with an unillustrated CPU and controlling an operation of the fixing motor, a fixing motor unit including a drive circuit, and a control IC. Reference numerals 304, 305 and 306 respectively designate a driver, a three-phase DC brushless motor of an outer rotor type, and a circuit for generating +5V for biases of a hole sensor and an MR sensor in a regulator having a predriver therein. Reference numerals 307, 308, 309 and 310 respectively designate a charge pump circuit for generating a gate voltage of an N-chMOS transistor of the driver, a predriver circuit, a logic circuit, and an electric current limiter circuit. Reference numerals 311 to 313 designate hole sensor amplifiers. Reference numeral 314 designates an MR sensor amplifier. Reference numerals 315 to 320 designate Nch-MOS transistors as driver portions. Reference numerals 321, 322, 323 and 324 respectively designate a resistor for detecting an electric current, a U-phase output connected to a U-phase coil of the motor, a V-phase output connected to a V-phase coil, and a W-phase output connected to a W-phase coil. Reference numerals 325 to 327 designate hole sensors. Reference numerals 328, 329 and 330 respectively designate an MR sensor, a motor starting signal outputted from the DSP, and a PWM signal outputted from the DSP. Reference numerals 331 and 332 respectively designate an MR sensor signal for detecting the velocity of the motor, and a serial communication bus for communicating with the unillustrated CPU.

A control operation of the fixing motor will next be explained.

First, when a fixing motor driving command is issued from the CPU through the serial communication line 332, the DSP 301 makes the motor starting signal 329 active with respect to the control IC 303 and generates a PWM pulse of ON-duty 80% in the PWM signal 330 so as to start the motor. The control IC 303 receives the starting signal 329 and magnetizing switching operations of N-chMOS transistors 315 to 320 are controlled by the logic circuit 309 so as to provide a predetermined rotating direction on the basis of a rotor position detected by hole sensors 325 to 327. Further, PWM switching operations of N-chMOS transistors 315, 317, 319 are performed by receiving the PWM signal 330. At this time, gate voltages of the N-chMOS transistors 315, 317, 319 are increased to Vcc+10 V by the charge pump circuit 307.

For example, when the logic circuit 309 recognizes the rotor position of the motor from results amplified by the hole sensors 325 to 327 and the hole sensor amplifiers 311 to 313 and a switching operation is performed in an electric current direction from the U-phase 322 to the V-phase 323 so as to provide a predetermined desirable rotating direction, the predriver 308 turns on N-chMOS transistors 315, 318 and turns off N-chMOS transistors 316, 317, 319, 320.

As a result, an electric current flows from Vcc to the electric current detecting resistor 321 through the N-chMOS transistor 315 via the U-phase output 322, the V-phase output 323 and the N-chMOS transistor 318 so that magnetic force is generated in a predetermined coil. At this time, PWM control of the N-chMOS transistor 315 is performed by the predriver 308 via the logic circuit 309 by using the PWM signal 330, given by the DSP 301.

Accordingly, the electric current of ON-duty prescribed by the PWM signal 330 flows from the U-phase to the V-phase. Thus, magnetizing switching control of the motor for switching the electric current to the U, V and W phases so as to rotate the rotor in a predetermined direction is performed so that torque is generated by an interaction between an unillustrated main pole magnet and a coil.

When the above magnetizing switching control of the motor is performed and the rotor is rotated, the MR sensor 328 detects a magnetic pattern for the MR sensor arranged in advance and 360 pulses are outputted per one rotation. Namely, a signal having a frequency according to a rotation number of the motor is obtained and is transmitted to the DSP 301 through the MR sensor signal line 331 via the amplifier 314.

In the control of a program of the DSP 301, a pulse interval of the MR sensor signal line 331 is measured and a velocity (rad/s) of the motor is calculated and is compared with a target control velocity. Further, a PWM pulse width is calculated by performing an unillustrated PI filter operation and a gain adding operation, and an electric current supplied to the motor is controlled through the PWM signal line 330 such that the motor is rotated at the target velocity.

Thus, the DSP 301 switches N-chMOS transistors at an output stage by using the PWM signal 330 and performs servo control so as to rotate the motor at a predetermined desirable rotation. In contrast to this, the control IC 303 performs magnetizing control on the basis of the detecting results of a main pole position of the rotor detected by hole sensors 325 to 327 so as to rotate the rotor in a predetermined desirable rotating direction, and also operates the N-chMOS transistors.

Further, the electric current flowing through the motor is detected by the electric current detecting resistor 321. The image forming apparatus also has a protecting circuit for limiting this electric current by the electric current limiter circuit 310 when an electric current greater than a predetermined electric current flows through the motor.

In this embodiment, a means for detecting and controlling the recording material convey velocity between the transferring nip portion T1 and the fixing nip portion T2 is explained, but the present invention is not limited to this means. For example, the present invention is effective with respect to loop amount detection and velocity control of all recording materials performed on a conveying path such as loop amount detection and velocity control of the recording material P performed between the sheet feeding roller 9 as a first conveying means and the registration roller pair 10 as a second conveying means. Further, the present invention can be also effectively applied to a roller-type fixing device constructed by a pair of rollers as well as the fixing device of a film system.

Further, a time required to make a flexing amount of the above recording material reach a predetermined amount may be divided into plural predetermined required time stages and plural recording material convey velocity changing amounts may be set in advance in accordance with these respective predetermined required time stages. In this case, a recording material convey velocity changing amount may be also selected from the above plural recording material convey velocity changing amounts in accordance with the time taken until the above flexing amount of the recording material reaches the predetermined amount.

The loop amount between the transferring portion and the fixing portion can be constantly held so as to lie within a predetermined range and the recording material can be stably conveyed in comparison with the conventional case by finely performing the velocity control on a fixing side even when the conveying distance between the transferring portion and the fixing portion is extremely short and the generated loop of the recording material is greatly formed by the velocity difference, or even when a convey velocity change on a film fixing device side is large and the generated loop of the recording material is greatly formed by the velocity difference as in a film fixing system.

Further, the sheet discharging sensor arranged on a sheet discharging side of the fixing means is also used as a detecting sensor of a tip of the recording material. It is also possible to provide a compact and cheap detecting means having a simple construction by setting each of the sheet discharging sensor and the loop sensor to a photointerrupter using a flag.

Further, a direct current servo motor is used as a driving source on a side (fixing device) performing rotating control so that no slow-up/down sequence is required in comparison with a stepping motor. In the direct current servo motor, it is sufficient to change only a target rotation number within the control loop.

Namely, when the target rotation number is changed, no velocity of the motor is suddenly changed by its inertia so that rise and fall of the rotation number become smooth. As a result, no slow-up/down sequence required in the case of the stepping motor is required so that control construction can be simplified.

Further, the direct current servo motor is inexpensive in comparison with an alternating current servo motor and its circuit is simplified and inexpensive in comparison with the alternating current servo motor. Furthermore, no primary and secondary safety standards are required and a control system is simplified since no electric current loop control is indispensable.

In the above embodiments, the recording material convey velocity in the fixing portion is controlled, but the recording material convey velocity in the transferring portion may be controlled.

An embodiment for stabilizing support of the recording material in a loop sensor portion will next be explained.

Figure 7A:
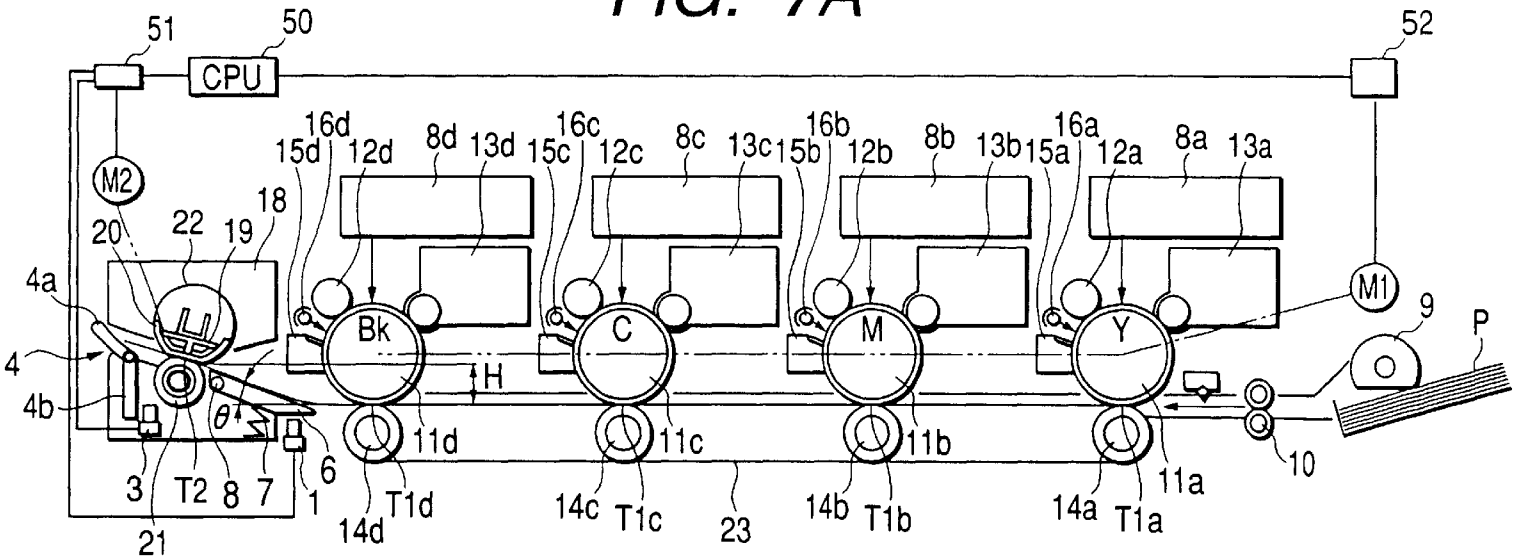
FIGS. 7A and 7B are views showing an image forming apparatus in another embodiment.
Figure 7B:
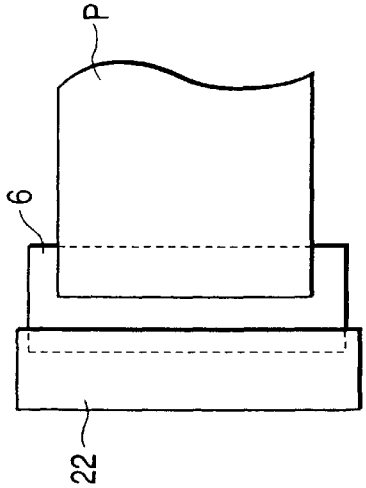
Figure 8:
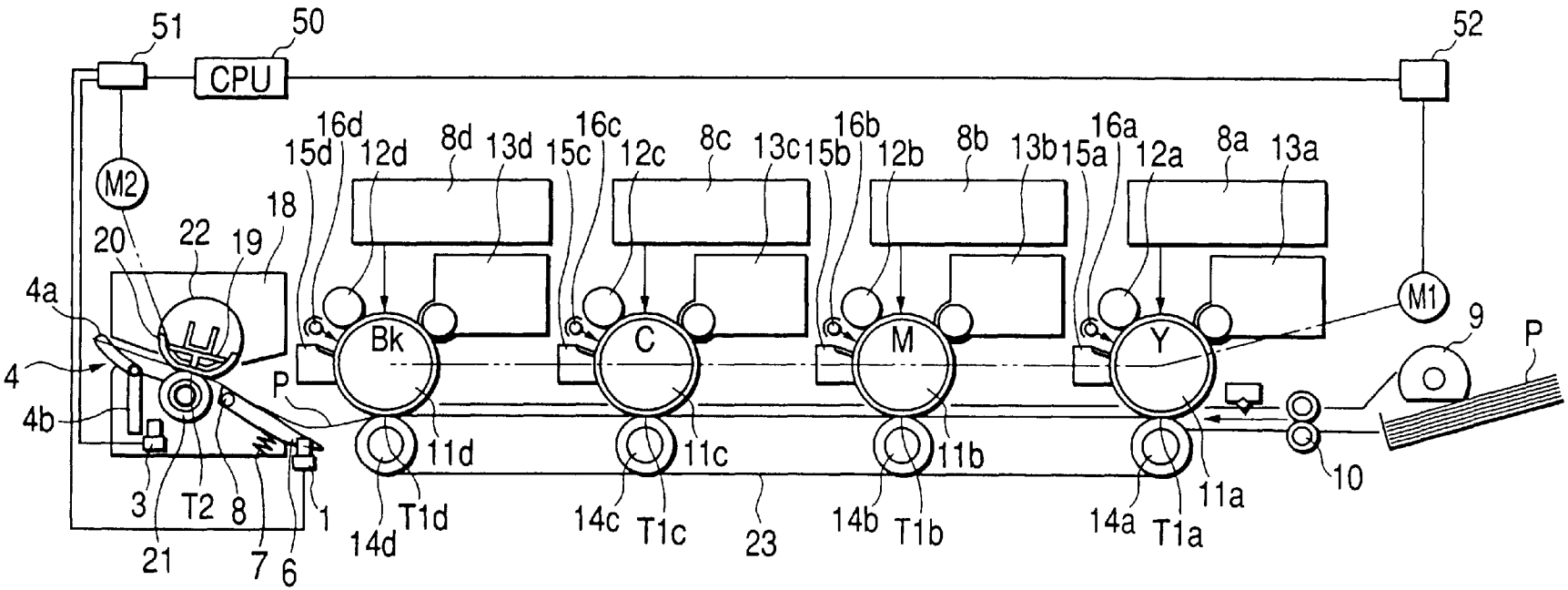
FIG. 8 is a view showing a state in which a predetermined flexing amount of a recording material is caused.

FIGS. 7A and 8 show a color laser beam printer in this embodiment. A basic construction of the color laser beam printer is similar to that in the above-mentioned embodiment, and a different portion of the basic construction will be therefore explained. FIG. 7B is a view of a portion near a fixing apparatus seen from above.

A recording material P having a toner image transferred in a transferring portion T1*d* is separated from the surface of a photosensitive drum 11*d*. The recording material P is conveyed onto a fixing inlet guide (conveying guide) 6 swingably arranged in a state in which a supporting shaft 8 having a swinging end directed to a side of the transferring portion T1*d* is set to a fulcrum, and is sent to a fixing device 18.

The fixing inlet guide 6 is arranged between the final transferring portion T1*d* and a nip portion of a fixing portion such that the above swinging tip is directed downward. The fixing inlet guide 6 is also arranged such that the fixing inlet guide 6 is opposed to the nip portion of the above fixing portion and is upward inclined. The fixing inlet guide 6 is arranged in the vicinity of a pressurizing toller 21 such that the fixing inlet guide 6 can be swung about the support shaft 8 parallel with this roller. The fixing inlet guide 6 is biased in the counterclockwise direction so as to form an angle θ by a spring 7 in a normal state. Here, the angle θ is set to range form 15° to 35° and the spring 7 biases the fixing inlet guide 6 in the counterclockwise direction by force of a dead weight of this fixing inlet guide 6 plus 30 g to 100 g in a state of FIG. 7A. As shown in FIG. 7B, the fixing inlet guide is longly arranged over a width of the recording material in a direction perpendicular to a moving direction of the recording material.

In contrast to this, the fixing device 18 in this embodiment is of an electromagnetic induction type and the pressurizing roller 21 of the fixing device 18 is rotated by a fixing motor M2 controlled in rotation by a controller 51 in the counterclockwise direction in FIG. 7A. A magnetizing coil 20 as a heating means is connected to an unillustrated magnetizing circuit of a main body of the image forming apparatus. Magnetic force is generated by applying a higher frequency bias to the magnetizing circuit. An induced current (eddy current) is generated by an action of this magnetic force in an unillustrated heating layer (ferromagnetic conductive layer) of the film 22 as a fixing rotating body so that an electromagnetic induction heating state is attained.

The recording material P having unfixed toner thereon is conveyed and guided from this state to the nip portion T2 between the film 22 and the pressurizing roller 21. Thus, the pressurizing force of an unillustrated pressurizing spring and heat from the film 22 heated by the electromagnetic induction are applied to the unfixed toner so that the unfixed toner is softened and melted and comes in press contact with the recording material P. Thereafter, the toner is set to a permanent fixed image by cooling.

Thereafter, the recording material P discharged from the nip portion T2 between the film 22 and the pressurizing roller 21 kicks (hits against) a sheet discharging sensor flag 4*a* and a photointerrupter as the sheet discharging sensor 3 detects an ON (paper existence) state from an OFF (paper nonexistence) state.

Here, the recording material convey velocity v1 (mm/s) in the fixing device 18 is set to be lower than the recording material convey velocity v0 (mm/s) in the transferring portion.

Namely, when a kind of the recording material in the fixing device 18, a continuous sheet passing number, thermal expansion of each of the parts in a temperature adjusting situation, dispersion in the pressurizing force, tolerance of a roller diameter, etc. are considered, a highest recording material convey velocity in the fixing device is set to v1 and v0>v1 is set.

Accordingly, a loop amount is increased by a convey velocity difference of the recording material P from the state of FIGS. 7A and 7B when a tip portion of the recording material P is nipped by the nip portion T2 of the fixing device 18.

In the state of FIG. 8, the fixing inlet guide 6 is swung downward by a predetermined amount against the spring 7 biasing the fixing inlet guide 6 by rigidity provided by the loop of the recording material P, and the loop detecting sensor 1 constructed by a photointerrupter is changed from an OFF state to an ON (loop detection) state.

Here, in this embodiment, the fixing portion nip T2 is arranged in a position higher by a height H than the transferring portion nip T1*d* so as to generate the loop on a lower side (on which the conveyed recording material is downward convex) by the recording material convey velocity difference between the fixing portion and the transferring portion as shown in FIGS. 7A, 7B and 8.

When the state shown in FIG. 8 is set to an appropriate state of the loop amount in the fixing inlet guide 6 of the recording material P, it is necessary to adjust the recording material convey velocity in the above fixing portion so as to hold this state.

The recording material convey velocity v0 in the transferring portion T1 is approximately constant, but the recording material convey velocity v1 in the fixing device nip portion T2 is greatly changed by a kind of the recording material, a continuous sheet passing number, thermal expansion of each of the parts in a temperature adjusting situation, dispersion in the pressurizing force, tolerance of a roller diameter, etc. as mentioned above.

Therefore, the convey velocity of the recording material P in the fixing device nip portion T2 must be accelerated when the loop detecting sensor 1 is turned on. As a result, after the loop is reduced and the loop detecting sensor 1 is turned off, the recording material convey velocity is decelerated to an appropriate recording material convey velocity such that the state of FIG. 8 is held.

A magnitude of the recording material convey velocity difference between the transferring portion and the fixing portion can be known from a time until the loop sensor 1 is turned on. Namely, the shorter a time from turning-on of the sheet discharging sensor 3 to turning-on of the loop sensor 1 is the greater recording material convey velocity difference between the transferring portion and the fixing portion.

As mentioned above, the rotating velocity of the fixing motor M2 is also controlled in this embodiment to constantly hold the loop amount between the transferring portion and the fixing portion by controlling the recording material convey velocity in the nip portion T2 of the fixing device 18. A control method is similar to that in the above embodiment.

In this embodiment, when the sheet discharging sensor 3 arranged on a fixing device discharging side is turned on (in a sheet passing state), the velocity control using the fixing motor M is performed by receiving a signal from the above loop detecting sensor 1. When the recording material convey velocity in the above fixing portion is reduced, the loop amount formed in the recording material is increased in the fixing inlet guide 6. As the loop amount is increased, force for pressing the fixing inlet guide 6 in the clockwise direction is increased. When the fixing inlet guide 6 is rotated in the clockwise direction against elastic force of the spring 7, an optical path of the loop sensor 1 is interrupted by a light interrupting plate arranged in the fixing inlet guide 6 and the loop sensor 1 is turned on. When the recording material convey velocity in the above fixing portion is reduced as it is, a loop length is increased so that a rotation number of the fixing motor M is increased. The loop length is reduced by this increase in the rotation number of the fixing motor M. Thus, the force for pressing the fixing inlet guide 6 is reduced and the fixing inlet guide 6 is rotated by the elastic force of the spring 7 in the counterclockwise direction to a position in which the fixing inlet guide 6 abuts on an unillustrated stopper. Then, the loop sensor 1 is turned off. When the rotation number of the fixing motor M is increased as it is, the recording material is tensioned as mentioned above. Therefore, the loop length of the recording material is increased by reducing the rotation number of the fixing motor M. However, when the loop length of the recording material is excessively increased, an image is easily rubbed. Accordingly, the loop length of the recording material until the loop sensor 1 is turned on by rotating the fixing inlet guide 6 is set to an appropriate loop length. When the loop sensor 1 is turned on, the rotation number of the fixing motor M is increased and the loop length is shortened.

Thus, in accordance with this embodiment, the recording material is conveyed while a rear face of the recording material is not partially received as in a flag, but is received on a face of the fixing inlet guide. Accordingly, the recording material can be stably conveyed and a change in load during transfer is restrained and a shift in each color, banding, etc. can be restrained.

Figure 9:
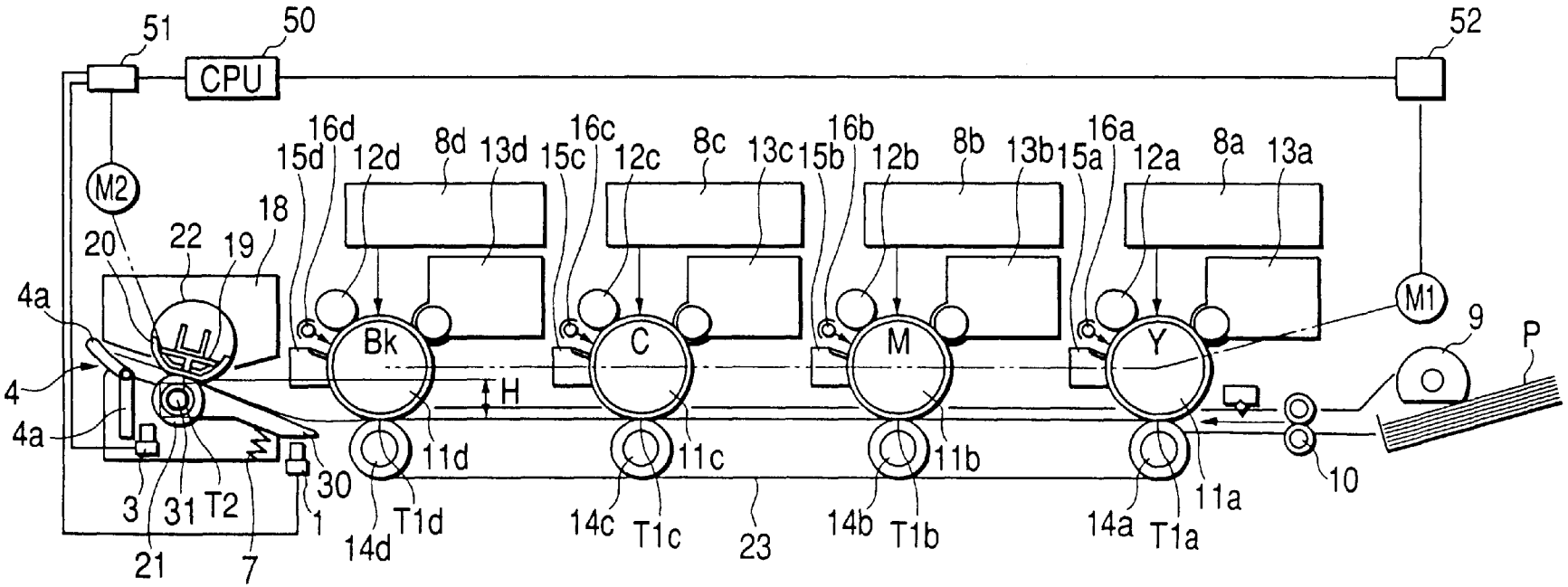
FIG. 9 is a view showing an image forming apparatus in another embodiment.

FIG. 9 shows another embodiment of the present invention.

This embodiment differs from the embodiment shown in FIGS. 7A and 7B in that a rotating fulcrum of a fixing inlet guide 30 is set as a rotating shaft 31 of a pressurizing roller 21 and the fixing inlet guide 30 can be swung about the rotating shaft 31.

In this embodiment, effects similar to those in the above embodiment can be obtained.

In the above description, the embodiments of the present invention are explained. However, the present invention is not limited to these embodiments, but can be modified in all forms within the technical idea of the present invention.

What is claimed is:

1. An image forming apparatus comprising:

an image bearing body;

a transferring portion for transferring an unfixed image on said image bearing body onto a recording material, while conveying the recording material;

a fixing portion for fixing the unfixed image onto the recording material, while conveying the recording material having the unfixed image transferred in said transferring portion;

flexure detecting means for detecting a flexure of the recording material between said transferring portion and said fixing portion;

recording material detecting means for detecting a presence/absence of the recording material at a downstream side of said fixing portion with respect to a conveying direction of the recording material; and control means for controlling a conveying velocity of the recording material in said fixing portion on the basis of a time period extending from a detection of the recording material detected by said recording material detecting means to a detection of the flexure of the recording material detected by said flexure detecting means.

2. An image forming apparatus according to claim 1, wherein the conveying velocity of the recording material in said fixing portion is increased as the time period is shortened.

3. An image forming apparatus according to claim 1, wherein said flexure detecting means includes an abutting member abutting against the recording material, and detects the flexure of the recording material by movement of said abutting member.

4. An image forming apparatus according to claim 3, wherein said abutting member includes a lever.

5. An image forming apparatus according to claim 3, wherein said abutting member includes a guide member for guiding the recording material extending in a direction perpendicular to the conveying direction of the recording material.

6. An image forming apparatus according to claim 1, further comprising a transferring roller for forming a transferring nip in cooperation with said image bearing body, wherein said transferring portion is said transferring nip.

7. An image forming apparatus according to claim 1, further comprising a pair of fixing members for forming a fixing nip, wherein said fixing portion is said fixing nip.

8. An image forming apparatus according to claim 7, wherein one of said pair of fixing members includes a roller having an elastic layer for operating the other of said pair of fixing members, and the unfixed image is heated and fixed onto the recording material in said fixing nip.

9. An image forming apparatus according to claim 1, further comprising a conveying member, which is provided at said fixing portion, for conveying the recording material, and a direct current servomotor for driving said conveying member.

10. An image forming apparatus according to claim 9, wherein said control means includes a digital signal processor, and wherein said digital signal processor controls said direct current servomotor, based on a time period extending from a detection of the recording material detected by said recording material detecting means to a detection of the flexure of the recording material detected by said flexure detecting means.

11. An image forming apparatus comprising:

first conveying means and second conveying means for conveying a recording material, said first conveying means being arranged at an upstream side of said second conveying means with respect to a conveying direction of the recording material;

flexure detecting means for detecting a flexure of the recording material between said first and second conveying means;

recording material detecting means for detecting a presence/absence of the recording material at a downstream side of said second conveying means with respect to the conveying direction of the recording material; and control means for controlling a recording material conveying velocity of at least one of said first and second conveying means on the basis of a time period extending from a detection of the recording material detected by said recording material detecting means to a detection of the flexure of the recording material detected by said flexure detecting means.

12. An image forming apparatus according to claim 11, wherein the recording material conveying velocity of at least one of said first and second conveying means is increased as the time period is shortened.

13. An image forming apparatus according to claim 11, wherein said flexure detecting means includes an abutting member abutting against the recording material, and detects the flexure of the recording material by movement of said abutting member.

14. An image forming apparatus according to claim 13, wherein said abutting member includes a lever.

15. An image forming apparatus according to claim 13, wherein said abutting member includes a guide member for guiding the recording material extending in a direction perpendicular to the conveying direction of the recording material.

16. An image forming apparatus according to claim 11, wherein each of said first and second conveying means includes a rotary member.

17. An image forming apparatus according to claim 11, wherein said conveying means of which the recording material conveying velocity is controlled by said control means, includes a direct current servomotor.

18. An image forming apparatus according to claim 17, wherein said control means further includes a digital signal processor, and wherein said digital signal processor controls said direct current servomotor on the basis of a time period extending from a detection of the recording material detected by said recording material detecting means to a detection of the flexure of the recording material detected by said flexure detecting means.

19. An image forming apparatus comprising:

an image bearing body;

a transferring portion for transferring an unfixed image on said image bearing body onto a recording material, while conveying the recording material;

a fixing portion for fixing the unfixed image onto the recording material, while conveying the recording material having the unfixed image transferred in said transferring portion; and a guide member for guiding the recording material to said fixing portion, said guide member arranged over a passage width of the recording material in a direction perpendicular to a moving direction of the recording material and guiding the recording material to said fixing portion, wherein said guide member is movable and a flexure of the recording material between said transferring portion and said fixing portion is detected by movement of said guide member.

20. An image forming apparatus according to claim 19, further comprising a fulcrum, wherein said guide member is swung about said fulcrum.

21. An image forming apparatus according to claim 20, wherein said fixing portion includes a roller and a rotating shaft, and wherein said fulcrum swings about said rotating shaft.

* * * * *

UNITED STATES PATENT AND TRADEMARK OFFICE

CERTIFICATE OF CORRECTION

PATENT NO. : 6,564,025 B2 
DATED : May 13, 2003
INVENTOR(S) : Takao Sameshima et al.

It is certified that error appears in the above-identified patent and that said Letters Patent is hereby corrected as shown below:

Title page,
Item [57], ABSTRACT,
Line 6, "is" should be deleted.

Column 3,
Lines 8 and 26, "A still" should read -- Still --.

Column 13,
Line 26, "form" should read -- from --.

Signed and Sealed this

Eighteenth Day of November, 2003

JAMES E. ROGAN
*Director of the United States Patent and Trademark Office*